US010435980B2

(12) United States Patent
Grace et al.

(10) Patent No.: US 10,435,980 B2
(45) Date of Patent: Oct. 8, 2019

(54) INTEGRATED ROTATING CONTROL DEVICE AND GAS HANDLING SYSTEM FOR A MARINE DRILLING SYSTEM

(71) Applicant: Halliburton Energy Services, Inc., Houston, TX (US)

(72) Inventors: Christopher Allen Grace, Fort Worth, TX (US); Raymond Ronald Bullock, Hoveton Norfolk (GB); Matthew Hassett Wiggins, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/751,493

(22) PCT Filed: Sep. 10, 2015

(86) PCT No.: PCT/US2015/049352

§ 371 (c)(1),
(2) Date: Feb. 9, 2018

(87) PCT Pub. No.: WO2017/044101

PCT Pub. Date: Mar. 16, 2017

(65) Prior Publication Data

US 2018/0258730 A1 Sep. 13, 2018

(51) Int. Cl.
*E21B 33/08* (2006.01)
*E21B 17/01* (2006.01)
(Continued)

(52) U.S. Cl.
CPC ..... *E21B 33/085* (2013.01); *E21B 7/128* (2013.01); *E21B 17/01* (2013.01); *E21B 21/08* (2013.01);
(Continued)

(58) Field of Classification Search
CPC ..... E21B 17/01; E21B 19/006; E21B 21/08; E21B 33/038; E21B 33/064; E21B 33/085; E21B 7/128
See application file for complete search history.

(56) References Cited

U.S. PATENT DOCUMENTS 4,626,135 A 12/1986 Roche
5,975,219 A 11/1999 Sprehe
(Continued)

FOREIGN PATENT DOCUMENTS

AU 2009268461 1/2010
AU 2011201664 11/2011
(Continued)

OTHER PUBLICATIONS

International Search Report and Written Opinion for PCT Patent Application No. PCT/2015/049352, dated Jun. 9, 2016; 12 pages.
(Continued)

*Primary Examiner* — James G Sayre
(74) *Attorney, Agent, or Firm* — Baker Botts L.L.P.

(57) ABSTRACT

An integrated rotating control device and gas handling system for a marine drilling system is disclosed. The system includes a flow spool; a riser sealing tool coupled to the flow spool; a rotating control device coupled to the riser sealing tool below a tension ring of a riser section of a drilling riser, the rotating control device fluidically coupled to the flow spool; and an auxiliary line routed around the rotating control device between the riser sealing tool and the riser section.

16 Claims, 4 Drawing Sheets

(51) Int. Cl.

| | |
|---|---|
| ***E21B 21/08*** | (2006.01) |
| ***E21B 33/038*** | (2006.01) |
| ***E21B 33/064*** | (2006.01) |
| ***E21B 7/128*** | (2006.01) |
| ***E21B 19/00*** | (2006.01) |

(52) U.S. Cl.
CPC ..... *E21B 33/038* (2013.01); *E21B 33/064* (2013.01); *E21B 19/006* (2013.01)

(56) References Cited

U.S. PATENT DOCUMENTS

| | | | | |
|---|---|---|---|---|
| 6,732,804 | B2 | 5/2004 | Bansal et al. | |
| 7,093,662 | B2 | 8/2006 | Debour | |
| 7,237,623 | B2 | 7/2007 | Hannegan | |
| 7,448,454 | B2 | 11/2008 | Bourgoyne | |
| 7,610,251 | B2 | 10/2009 | Shayesi et al. | |
| 7,699,109 | B2 | 4/2010 | May et al. | |
| 7,997,345 | B2 | 8/2011 | Hannegan et al. | |
| 8,016,033 | B2 | 9/2011 | Bailey et al. | |
| 8,109,337 | B2 | 2/2012 | Parlee et al. | |
| 8,261,840 | B2 | 9/2012 | Parlee et al. | |
| 8,347,982 | B2 | 1/2013 | Bailey et al. | |
| 8,408,330 | B2 | 4/2013 | Hutin et al. | |
| 8,479,829 | B2 | 7/2013 | Stachowiak et al. | |
| 8,573,325 | B2 | 11/2013 | Maida et al. | |
| 8,720,545 | B2 | 5/2014 | Bailey et al. | |
| 8,770,297 | B2 | 7/2014 | Bailey et al. | |
| 8,820,747 | B2 | 9/2014 | Costo et al. | |
| 8,844,652 | B2 | 9/2014 | Sokol et al. | |
| 8,863,858 | B2 | 10/2014 | Bailey et al. | |
| 8,899,348 | B2 | 12/2014 | Henderson et al. | |
| 8,939,235 | B2 | 1/2015 | Bailey et al. | |
| 2010/0008190 | A1 | 1/2010 | Bailey et al. | |
| 2011/0127040 | A1 | 6/2011 | Humphreys et al. | |
| 2011/0315404 | A1 | 12/2011 | Anderson et al. | |
| 2012/0055677 | A1 | 3/2012 | Boyd | |
| 2012/0085545 | A1 | 4/2012 | Tarique et al. | |
| 2012/0227978 | A1 | 9/2012 | Fossli et al. | |
| 2013/0068532 | A1 | 3/2013 | Bansal et al. | |
| 2013/0192841 | A1 | 8/2013 | Feasey et al. | |
| 2013/0206422 | A1 | 8/2013 | Carbaugh et al. | |
| 2013/0341052 | A1 | 12/2013 | Bailey et al. | |
| 2014/0048331 | A1 | 2/2014 | Said et al. | |
| 2014/0069720 | A1 | 3/2014 | Gray | |
| 2014/0178155 | A1 | 6/2014 | Feasey et al. | |
| 2014/0182943 | A1 | 7/2014 | Bailey et al. | |
| 2014/0190701 | A1 | 7/2014 | Humphreys et al. | |
| 2014/0209316 | A1* | 7/2014 | Tindle | E21B 33/035 166/345 |
| 2014/0216751 | A1 | 8/2014 | Liezenberg et al. | |
| 2014/0238686 | A1 | 8/2014 | Boyd et al. | |
| 2014/0262313 | A1* | 9/2014 | Gilmore | E21B 33/085 166/363 |
| 2014/0339772 | A1 | 11/2014 | Ahmend | |
| 2015/0021045 | A1 | 1/2015 | Boyd et al. | |
| 2015/0027717 | A1 | 1/2015 | Ma et al. | |
| 2015/0034326 | A1 | 2/2015 | Bailey et al. | |

FOREIGN PATENT DOCUMENTS

| | | | |
|---|---|---|---|
| AU | 2011244852 | 12/2011 | |
| AU | 2008282452 | 3/2012 | |
| AU | 2012202558 | 5/2012 | |
| AU | 2010340372 | 6/2012 | |
| AU | 2012203290 | 6/2012 | |
| AU | 2014200850 | 4/2014 | |
| AU | 2011378761 | 5/2014 | |
| AU | 2014202900 | 6/2014 | |
| AU | 2014203505 | 7/2014 | |
| AU | 2013302660 | 2/2015 | |
| CA | 2486673 | 9/2007 | |
| CA | 2809156 | 2/2009 | |
| CA | 2809159 | 2/2009 | |
| CA | 2782168 | 6/2011 | |
| CA | 2737172 | 10/2011 | |
| CA | 2803957 | 1/2012 | |
| CA | 2751179 | 2/2012 | |
| CA | 2641296 | 10/2012 | |
| CA | 2841609 | 1/2013 | |
| CA | 2856071 | 3/2013 | |
| CA | 2694482 | 5/2013 | |
| CA | 2876067 | 12/2013 | |
| CA | 2729323 | 9/2014 | |
| EP | 2050924 | 10/2010 | |
| EP | 2179124 | 12/2011 | |
| EP | 2507468 | 10/2012 | |
| EP | 2532829 | 1/2013 | |
| EP | 2420647 | 5/2013 | |
| EP | 2585671 | 5/2013 | |
| EP | 2415960 | 11/2013 | |
| EP | 2532828 | 11/2013 | |
| EP | 2766563 | 8/2014 | |
| EP | 2521836 | 9/2014 | |
| EP | 2378056 | 10/2014 | |
| EP | 2318643 | 4/2015 | |
| GB | 2404407 | 8/2005 | |
| GB | 2443561 | 5/2008 | |
| WO | 2011067353 | 10/2008 | |
| WO | 2009018173 | 4/2009 | |
| WO | 2010006217 | 1/2010 | |
| WO | 2011084159 | 7/2011 | |
| WO | 2012001402 | 11/2012 | |
| WO | 2013006963 | 1/2013 | |
| WO | 2013037049 | 3/2013 | |
| WO | 2013055351 | 4/2013 | |
| WO | 2013164478 | 11/2013 | |
| WO | 2013185227 | 12/2013 | |
| WO | 2014099965 | 6/2014 | |
| WO | 2014105043 | 7/2014 | |
| WO | 2014120130 | 8/2014 | |
| WO | 2014/150816 | 9/2014 | |
| WO | 2014151724 | 9/2014 | |
| WO | 2014/179532 | 11/2014 | |
| WO | 2014179538 | 11/2014 | |
| WO | WO-2014179532 A1 * | 11/2014 | E21B 17/01 |

OTHER PUBLICATIONS

Toralde, Julmar. "RCD for DP drillship takes MPD deeper." Retrieved from url: http://www.drillingcontractor.org/rcd-for-dp-drillship-takes-mpd-deeper-9925, Jul. 14, 2011; 4 pages.

Tangedahl, M. J., and C. R. Stone. "Rotating preventers." World Oil 213.10 (1992): 63-66, (abstract only); 1 page.

* cited by examiner

INTEGRATED ROTATING CONTROL DEVICE AND GAS HANDLING SYSTEM FOR A MARINE DRILLING SYSTEM

RELATED APPLICATIONS

This application is a U.S. National Stage Application of International Application No. PCT/US2015/049352 filed Sep. 10, 2015, which designates the United States, and which is incorporated herein by reference in its entirety.

TECHNICAL FIELD

The present disclosure relates generally to drilling tools and, more particularly, to systems deployed on a marine drilling riser.

BACKGROUND

Hydrocarbons, such as oil and gas, are commonly obtained from subterranean formations that may be located offshore. The development of subterranean operations and the processes involved in removing natural resources from a subterranean formation are complex. Typically, subterranean operations involve a number of different steps such as, for example, drilling a borehole at a desired well site, treating the borehole to optimize production of the natural resources, and performing the necessary steps to produce and process the natural resources from the subterranean formation.

In a marine environment, subterranean operations may be performed by using a marine drilling riser. Marine drilling risers provide a channel for returning the drilling fluid and any additional solids and/or fluids from the borehole back to surface.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

During a subterranean operation, a gas handler system including a flow spool, a riser sealing tool, and a rotating control device is integrated into a marine drilling riser. The gas handler system is located within the marine drilling riser, below the tension ring and above the drilling unit seabed blow out preventer (BOP) stack. The gas handler system may be inserted at any depth below the tension ring based on the specific marine riser installation and operations to be performed. Auxiliary lines extend along the outer perimeter of the marine drilling riser from the well and are routed around the rotating control device, using crossover spools, to a termination joint located uphole from the rotating control device. The integration of the rotating control device, the riser sealing tool, and the flow spool into a gas handler system may reduce the number of components on the marine drilling riser thus reducing the cost and complexity associated with deploying the marine drilling riser. Additionally, by routing the auxiliary lines around the outer body of the rotating control device, the design of the rotating control device remains constant from one marine drilling riser configuration to another, reducing the cost associated with deploying a marine drilling riser. Embodiments of the present disclosure and its advantages are best understood by referring to FIGS. 1 through 4, where like numbers are used to indicate like and corresponding parts.

Figure 1A:
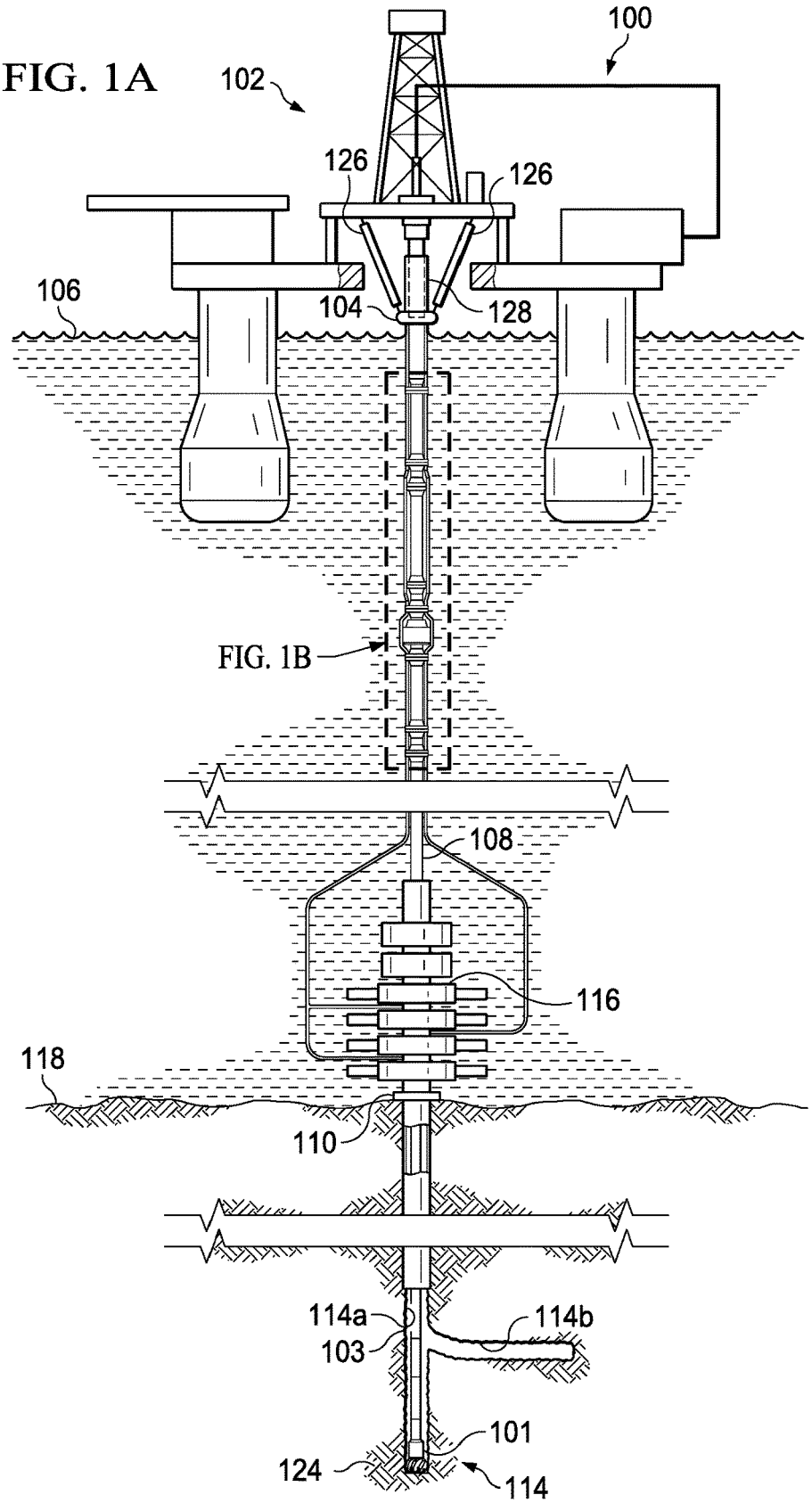
FIG. 1 is an elevation view of an example embodiment of a drilling system.
Figure 1B:
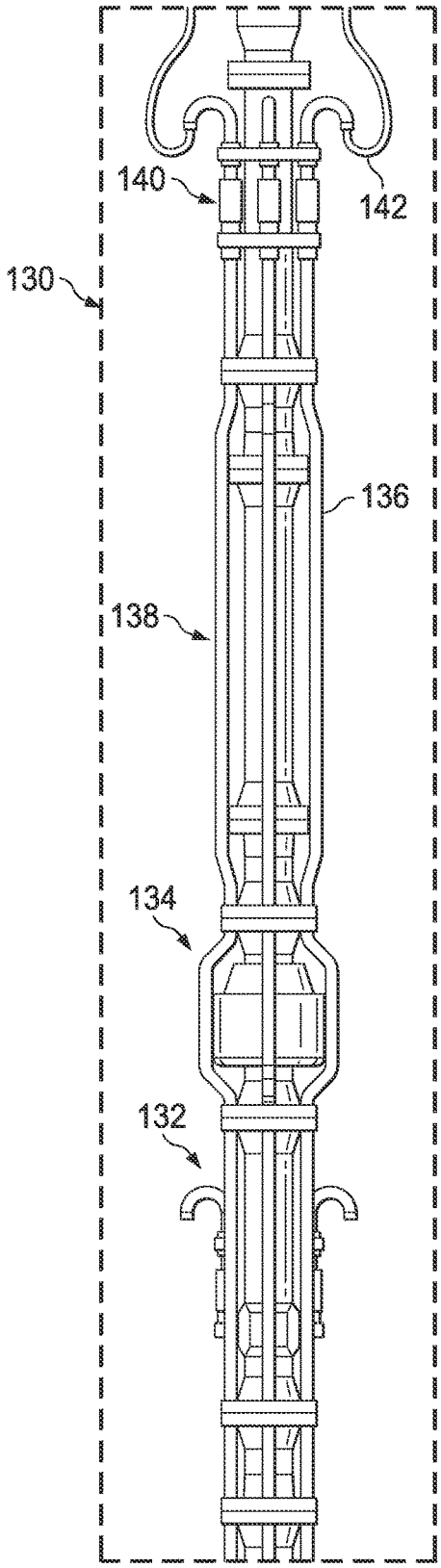

FIG. 1 is an elevation view of an example embodiment of a drilling system 100. Drilling system 100 is located at surface 106. Various types of drilling equipment such as a rotary table, drilling fluid pumps, and drilling fluid tanks (not expressly shown) may be located at surface 106. For example, surface 106 may include drilling rig 102 that may have various characteristics and features associated with a floating rig. However, downhole drilling tools incorporating teachings of the present disclosure may be satisfactorily used with drilling equipment located on any type of offshore platform, drill ship, semi-submersible, and drilling barge (not expressly shown).

Marine drilling riser 108 connects drilling rig 102 to well 110. Marine drilling riser 108 may be formed of one or more riser sections. The riser sections may be coupled together to span the distance from well 110 to surface 106. Marine drilling riser 108 is supported by tension ring 104. Tension ring 104 provides an attachment point for tensioner cables (or hydraulic members) 126 that provide constant tension to marine drilling riser 108 as drilling rig 102 heaves due to waves, tides, etc. Tension ring 104 may be connected to telescoping joint 128. Telescoping joint 128 may include an inner barrel and an outer barrel (not expressly shown) that move relative to each other in order to allow drilling rig 102 to move during drilling operations without breaking drill string 103 and/or marine drilling riser 108.

Marine drilling riser 108 may be connected to a blowout preventer (BOP) stack 116 positioned on seabed 118. BOP stack 116 may include one or more BOPs and may include any suitable type of BOP including ram BOPs, annular BOPs, and shear BOPs. BOP stack 116 seals, controls, and monitors well 110. For example, during a subterranean operation, uncontrolled flows of fluids including oil, gas, or both from formation 124, referred to as formation kicks, can create pressures that may cause marine drilling riser 108, drill string 103, and/or other drilling tools to be blown out of wellbore 114. BOP stack 116 may provide a failsafe to regulate and monitor the pressure in wellbore 114 such that the effects of a formation kick are minimized. Additionally, BOP stack 116 may protect the safety of drilling rig 102, the crew working on or near drilling rig 102, and the environment surrounding drilling rig 102 and wellbore 114 by preventing drilling tools and well effluents, such as gas, oil, water, and/or drilling mud, from being blown out of wellbore 114.

Marine drilling riser 108 may include drill string 103 that extends from drilling rig 102 through marine drilling riser 108 and into a subsea wellbore 114 formed in seabed 118. Drill string 103 is associated with drill bit 101 that may be used to form a wide variety of wellbores or bore holes such as generally vertical wellbore 114*a*, generally horizontal wellbore 114*b*, a directional wellbore (not shown), or any combination thereof. The term directional drilling may be used to describe drilling a wellbore or portions of a wellbore that extend at a desired angle or angles relative to vertical. Such angles may be greater than normal variations associated with vertical wellbores.

Marine drilling riser 108 may additionally include gas handling system 130 that includes flow spool 132 and riser sealing tool 134. Flow spool 132 may be located below riser sealing tool 134 and may divert fluids and/or gases to a choke manifold (not expressly shown) located on drilling rig 102. Riser sealing tool 134 may be any type of tool used to seal a riser, such as an annular BOP, pipe ram, or other wellbore sealing tools. During a formation kick, in the event that BOP stack 116 is unable to get the well under control, riser sealing tool 134 may act as an additional fail safe by closing to shut in marine drilling riser 108. Flow spool 132 may then divert fluids and/or gases through auxiliary lines 136 to drilling rig 102 until the pressure in wellbore 114 has decreased and the well is under control. Pressure in wellbore 114 may be decreased by a combination of operations solely or collectively which may involve controlled flow procedures from flow spool 132, closing of rams or annular BOP at BOP stack 106, and controlled flow procedures via the drilling rigs choke and kill lines.

Gas handling system 130 may also include rotating control device (RCD) 138. RCD 138 may also be referred to as a rotating drilling device, a rotating drilling head, a rotating flow diverter, pressure control device, or a rotating annular. RCD 138 may be used to perform closed annulus drilling operations, typically referred to as managed pressure drilling, underbalanced drilling, mud cap drilling, air drilling and mist drilling. Closed annulus drilling operations may provide constant circulation through connections within wellbore 114 and drill string 103 and provide a pressurized fluid system by applying back pressure at RCD 138 that extends through the components of drilling system 100 that are downhole of RCD 138. During closed annulus drilling operations, RCD 138 may divert drilling fluids returning from the well into chokes, separators, and other equipment. RCD 138 may function to close off the annulus between drill string 103 and marine drilling riser 108 during drilling operations. The sealing mechanism of RCD 138 (not expressly shown), typically referred to as a seal element or packer, may maintain a dynamic seal on the annulus, enabling chokes to control pressure of the annulus during the drilling operations. The seal element may further allow drilling to continue while controlling influx of formation fluids.

Auxiliary lines 136 may be routed around the outer body of RCD 138 through the use of crossover spools, as described in further detail in FIGS. 2A-4. Auxiliary lines 136 may run along the outer perimeter of marine drilling riser 108 from well 110 to termination joint 140. At termination joint 140, rigid auxiliary lines 136 are transitioned to flexible hoses 142 which may be attached to tanks, pumps, filters, and other components of drilling rig 102.

The integration of RCD 138 into gas handling system 130 may allow RCD 138 to use flow spool 132 and riser sealing tool 134 to assist RCD 138 in performing the functions of closed annulus drilling operations including diverting drilling fluids and seal the annulus. Without the integration of RCD 138 and gas handling system 130, RCD 138 may use a dedicated flow spool and riser sealing tool for RCD 138. Therefore, the complexity and cost of drilling system 100 is reduced by reducing the number of components of marine drilling riser 108.

Figure 2A:
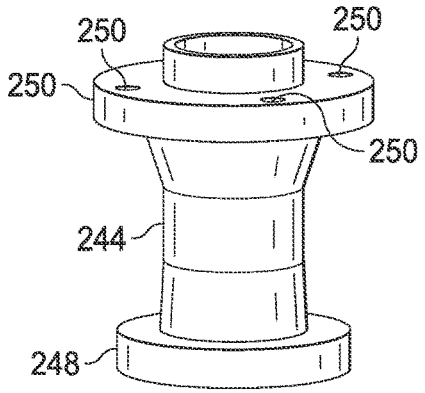
FIG. 2A is a perspective view of a crossover spool.
Figure 2B:
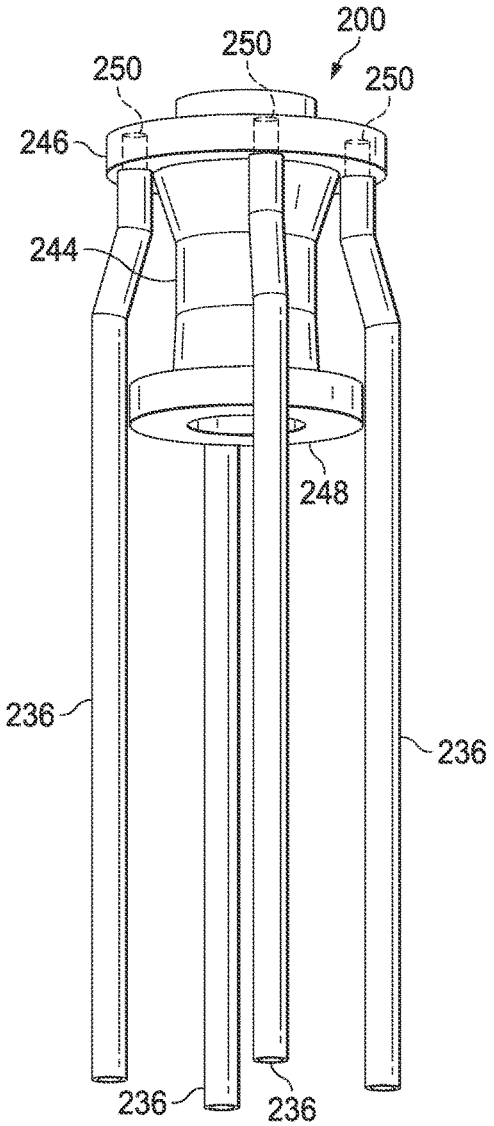
FIG. 2B is a perspective view of the crossover spool of FIG. 2A with auxiliary lines installed.

FIG. 2A is a perspective view of a crossover spool and FIG. 2B is a perspective view of the crossover spool of FIG. 2A with auxiliary lines installed. Crossover spool 244 may be located on at least one end of an RCD to couple the RCD to a marine drilling riser, to a gas handling system, or both, such as coupling one end of RCD 138 to marine drilling riser 108 and the other end of RCD 138 gas handling system 130 shown in FIG. 1. Crossover spool 244 may have riser connection 246 on one end and RCD connection 248 on the other end. Riser connection 246 may be any suitable connection that couples crossover spool 244 to the marine drilling riser including a bolted flange connection, a clamped flange connection, a clip connector riser joint, a split ring locking mechanism riser joint, or any other riser style marine drilling riser connection. RCD connection 248 may be any suitable connection that couples crossover spool 244 to the RCD including a bolted flange connection, a clamped flange connection, a clip connector riser joint, a split ring locking mechanism riser joint, or any other riser style marine drilling riser connection.

The diameter of crossover spool 244 may vary based on the diameter of the marine drilling riser and the diameter of the RCD. For example, the diameter of riser connection 246 may correspond to the diameter of the marine drilling riser and the diameter of RCD connection 248 may correspond to the diameter of the RCD. In other examples, the diameter of riser connection 246 may be larger than the diameter of RCD connection 248 such that auxiliary lines 236 may be routed around the outer body of the RCD.

Riser connection 246 may additionally include fittings 250 through which auxiliary line 236 may be routed. Fittings 250 may be openings on riser connection 246 that allow auxiliary lines 236 to pass through fittings 250. Fittings 250 may align with auxiliary lines that run along the length of the outer perimeter of the marine drilling riser such that the auxiliary lines attached to the marine drilling riser may be aligned with auxiliary lines 236 at fittings 250. Auxiliary lines 236 may be choke, kill, booster lines, or any combination thereof that are routed along the outer perimeter of the marine drilling riser from the well to the termination joint. Once crossover spool 244 is installed on the marine drilling riser and an RCD is connected to RCD connection 248, auxiliary lines 236 may be inserted into fittings 250, as shown in FIG. 2B, to route auxiliary lines 236 around the body of the RCD. The number of fittings 250 and auxiliary lines 236 may vary based on the number of auxiliary lines running along the length of the marine drilling riser from the well to the termination joint. For example, the number of fittings 250 and auxiliary lines 236 may be the same as the number of auxiliary lines on the marine drilling riser.

Crossover spool 244 may be made of any suitable material that can withstand the conditions in the marine drilling riser and the offshore environment. For example, crossover spool 244 may be made of stainless steel or an alloy steel. Additionally, crossover spool 244 may be designed to withstand the loading conditions present in the marine drilling riser assembly. The components of the marine drilling riser below the tension ring, including crossover spool 244, are subject to loading and stresses due to the tensile stresses caused by the weight of the marine drilling riser below the component, the tensile stresses caused by the riser tensioners pulling up on the tension ring, bending stresses due caused by ocean currents, and tensile stresses due to the internal burst pressure inside the marine drilling riser. Therefore, crossover spool 244 may be designed to have a similar load rating as the marine drilling riser on which crossover spool 244 is being deployed. Further, crossover spool 244 may be designed to withstand the high pressure conditions present in an offshore environment. For example, crossover spool 244 is subject to pressure forces due to the hydrostatic pressure exerted on crossover spool 244 by the water. Therefore, crossover spool 244 may be designed such that crossover spool 244 can withstand the hydrostatic pressure without deforming or compromising the structural integrity of crossover spool 244.

Figure 3:
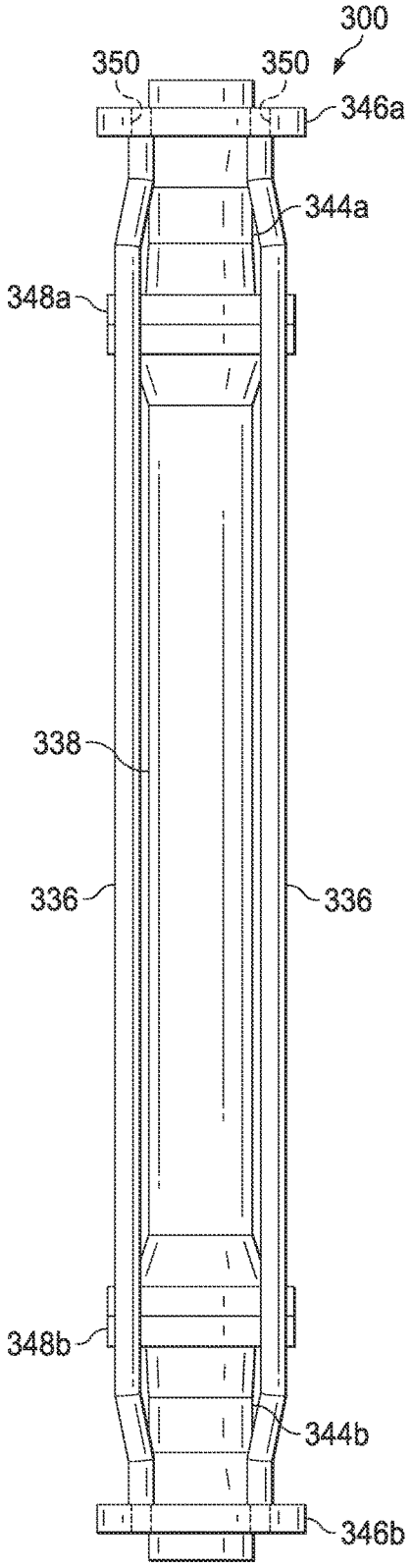
FIG. 3 is a perspective view of an RCD with crossover spools located on both axial ends of the RCD and auxiliary lines routed around the RCD.

FIG. 3 is a perspective view of an RCD with crossover spools located on both axial ends of the RCD and auxiliary lines routed around the RCD. RCD 338 is connected to a marine drilling riser below both a tension ring and a riser termination joint. Crossover spools 344*a* and 344*b* may be similar to crossover spool 244 shown in FIGS. 2A and 2B and auxiliary lines 336 may be similar to auxiliary lines 236, shown in FIG. 2B. Crossover spools 344*a* and 344*b* may be used to route auxiliary lines 336 around RCD 338.

Crossover spools 344*a* and 344*b* route auxiliary lines 336 around RCD 338 to enable the deployment of RCD 338 on a variety of marine drilling riser configurations without changing the configuration of RCD 338. For example, the diameter of and number of auxiliary lines on a marine drilling riser vary depending on the requirements of the subterranean operation. Crossover spools 344*a* and 344*b* may be designed and manufactured in a variety of sizes and having various numbers of fittings 350 such that RCD connector 348 has a diameter compatible with the diameter of RCD 338 while riser connector 346 has a diameter compatible with the diameter of the marine drilling riser such that a crossover spool 344 with a compatible riser connector may be selected for a given marine drilling riser configuration.

RCD 338 uses a flow spool to perform closed annulus drilling techniques to provide fluid flow from the interior of the marine drilling riser assembly below RCD 338 to the drilling rig. For example, RCD 338 may use the flow spool to control the annular pressure in the drill string and wellbore by forcing drilling fluid to flow out of the flow spool to the drilling rig through return lines. To reduce the number of components of a marine drilling riser, RCD 338 may be integrated with other components of a gas handler system such that RCD 338 can use the flow spool of the gas handler system instead of the marine drilling riser including a dedicated flow spool for RCD 338.

Figure 4:
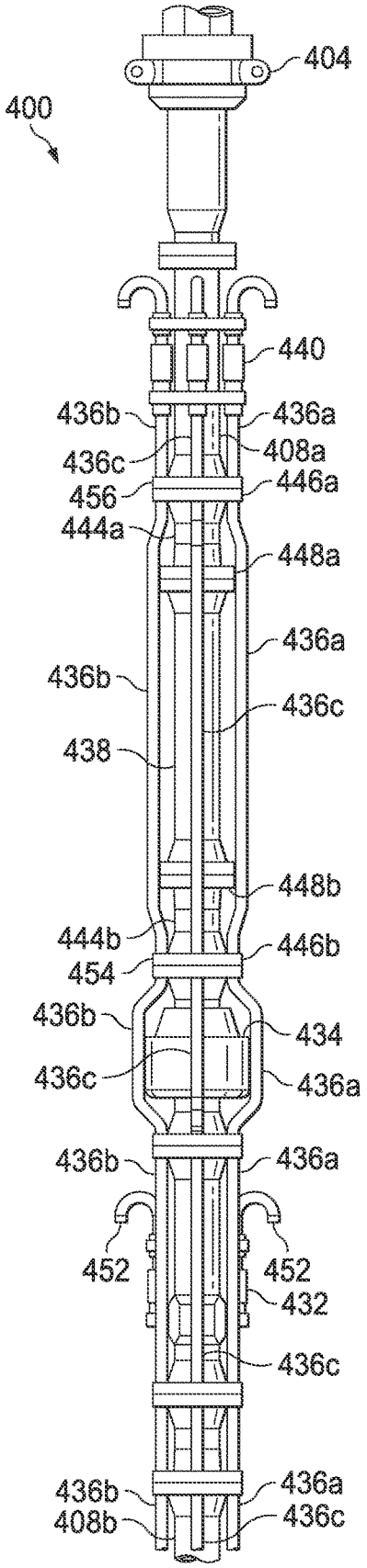
FIG. 4 is a perspective view of a gas handler system for use in a marine drilling riser.

FIG. 4 is a perspective view of a gas handler system for use in a marine drilling riser. Gas handler system 400 includes flow spool 432, riser sealing tool 434, and RCD 438. Gas handler system 400 may be coupled to riser section 408*a* at an uphole end and riser section 408*b* at a downhole end of gas handler system 400. Riser section 408*b* is a section of a marine drilling riser that extends from a drilling rig to a well, as shown by marine drilling riser 108 in FIG. 1. Riser section 408*b* may have auxiliary lines 436*a-c* extending along the outer perimeter of riser section 408*b*. Riser section 408*b* may have any number of auxiliary lines 436 based on the marine drilling riser configuration.

Auxiliary lines 436 may be choke, kill, booster lines, or any combination thereof that may be used to circulate fluids and/or gases into and out of the wellbore to control the pressure in the wellbore. Auxiliary lines 436 may have any configuration based on the parameters of the subterranean operation including any suitable cross-sectional shape and diameter.

Flow spool 432 may be a directional control valve that directs fluid and/or gas flow along different paths. Flow spool 432 may direct fluids, gases, or both into and out of the marine drilling riser. Flow spool 432 may include ports 452 where flexible flow lines (not expressly shown) are coupled. The flexible flow lines may be connected to the drilling rig and provide a flow path for fluids, gases, or both from the marine drilling riser to the drilling rig.

Riser sealing tool 434 may be coupled to flow spool 432 and may be any type of tool used to seal a riser, such as an annular BOP. Riser sealing tool 434 may be similar to riser sealing tool 134, described with reference to FIG. 1 such that riser sealing tool 434 may control the pressure in the well during a formation kick to maintain control of the fluids and/or gases being pumped from the wellbore. Riser sealing tool 434 may include a seal (not expressly shown) that seals the drill string, the marine drilling riser, or both to prevent fluids, gases, or both from leaking out of the drill string, the marine drilling riser, or both and into the surrounding environment.

During a formation kick event, when riser sealing tool 434 has sealed the annular space between the drill string and the marine drilling riser, flow spool 432 may divert fluids, gases, or both through the flexible flow lines connected to flow spool 432 at ports 452, through auxiliary lines 436, or both. riser sealing tool 434 may unseal the annular space between the drill string and the marine drilling riser when the formation kick conditions cease to exist and the pressure in the wellbore has decreased.

During a subterranean operation, the rotation of the drill string ceases before riser sealing tool 434 is engaged to seal the annular space between the drill string and the marine drilling riser. Therefore, RCD 438 may be used to seal the annular space between the drill string and the marine drilling riser during a drilling operation while the drill string is rotating such as a closed annulus drilling operation. During closed annulus drilling operations, RCD 438 may be used to seal the annulus between the drill string and the marine drilling riser. By sealing the annulus between the drill string and the marine drilling riser, RCD 438 prevents fluids and or gases returning from the wellbore from flowing through the annulus. The sealing elements in RCD 438 are housed in bearings such that the sealing elements rotate with the drill string during the drilling operation. When the sealing elements of RCD 438 are engaged, the drilling system downhole from RCD 438 is pressurized. The pressure in the annulus is controlled to allow drilling to continue while managing fluids and/or gases entering the wellbore from the formation. Because RCD 438 seals the annulus between the drill string, the marine drilling riser, or both, drilling fluids returning from the well may be diverted into chokes, separators, and/or other equipment on the marine drilling riser to return the drilling fluids to the drilling rig.

RCD 438 may use flow spool 432 to perform the closed annulus drilling techniques such that fluids, gases, or both may flow from the interior of the marine drilling riser to the drilling rig. For example, RCD 438 may use flow spool 432 to control the annular pressure in the annulus between the drill string and the marine drilling riser by forcing the flow of drilling fluid out of flow spool 432 to the drilling rig through return lines connected to ports 452. The use of flow spool 432 by RCD 438 may reduce the number of components of the marine drilling riser such that RCD 438 uses flow spool 438 instead of including a dedicated flow spool for RCD 438 on the marine drilling riser. This reduces the cost and complexity of deploying the marine drilling riser.

RCD 438 may be coupled to riser sealing tool 434 by crossover spool 444*b*. Crossover spool 444*b* may be similar to crossover spool 244 shown in FIGS. 2A and 2B. Crossover spool 444*b* may include riser connector 446*b* and RCD connector 448*b*. The diameter of riser connector 446*b* may be different from the diameter of RCD connector 448*b* such that crossover spool 444*b* tapers from the diameter of riser connector 446*b* to the diameter of RCD connector 448*b*. The diameter of riser connector 446*b* may be compatible with the diameter of connection point 454 on riser sealing tool 434 such that riser connector 446*b* may couple to connection point 454. Riser connector 446*b* may be coupled to connection point 454 via any suitable connection type including a bolted flange connection, a clamped flange connection, a clip connector riser joing, a split ring locking mechanism riser joint, or any other riser style marine drilling riser connection.

Crossover spool 444*b* may include fittings (not expressly shown) configured to direct auxiliary lines 436 from riser sealing tool 434 past the coupling between riser sealing tool 434 and RCD 438. The fittings may be similar to fittings 250 described with reference to FIGS. 2A and 2B. The fittings may align with auxiliary lines 436 on riser sealing tool 434 such that the flow of fluids, gases, or both through auxiliary lines is uninterrupted when transitioning across the junction between riser sealing tool 434 and crossover spool 444*b*.

Crossover spool 444*b* may route auxiliary lines 436 around the outer body of RCD 438 to crossover spool 444*a*. Crossover spool 444*a* may couple RCD 438 to riser section 408*a*. Crossover spool 444*a* may be similar to crossover spool 244 shown in FIGS. 2A and 2B. Crossover spool 444*a* may include riser connector 446*a* and RCD connector 448*a*. The diameter of riser connector 446*a* may be different from the diameter of RCD connector 448*a* such that crossover spool 444*a* tapers from the diameter of riser connector 446*a* to the diameter of RCD connector 448*a*. The diameter of riser connector 446*a* may be compatible with the diameter of connection point 456 on riser section 408*a* such that riser connector 446*a* may couple to connection point 456. Riser connector 446*a* may be coupled to connection point 456 via any suitable connection type including a bolted flange connection, a clamped flange connection, a clip connector riser joing, a split ring locking mechanism riser joint, or any other riser style marine drilling riser connection.

Crossover spool 444*a* may include fittings (not expressly shown) configured to direct auxiliary lines 436 from around the outer body of RCD 438 past the coupling between RCD 438 and riser section 408*a*. The fittings may be similar to fittings 250 described with reference to FIGS. 2A and 2B. The fittings may align with auxiliary lines 436 on riser section 408*a* such that the flow of fluids and/or gases through auxiliary lines is uninterrupted when transitioning across the junction between crossover spool 444*a* and riser section 408*a*.

The use of crossover spools 444*a* and 444*b* to route auxiliary lines 436 around the outer body of RCD 438 allow the use of RCD 438 with a variety of configurations of marine drilling risers without modifying RCD 438. For example, RCD 438 may be used on marine drilling risers having different diameters. When moving RCD 438 from a first marine drilling riser having a first diameter to a second marine drilling riser having a second diameter, only the configuration of crossover spools 444*a* and/or 444*b* changes. A first crossover spool 444*a* with a riser connector 446*a* of a diameter corresponding to the first diameter may be used with the first marine drilling riser and a second crossover spool 444*b* with a riser connector 446*b* of a diameter corresponding to the second diameter may be used with the second marine drilling riser. The design of the first and second crossover spools may additionally be modified based on the number of auxiliary lines 436 extending along the outer perimeter of the first and second marine drilling risers such that the first and second crossover spools have a corresponding number of fittings.

Riser section 408*a* may be coupled to termination joint 440. Fluids, gases, or both flowing through auxiliary lines 436 may transition from auxiliary lines 436 to flexible hoses at termination joint 440. The fluids, gases, or both may then flow through the flexible hoses to the drilling rig.

Termination joint 440 may be coupled to tension ring 404. Tension ring 404 is supported by tensioner cables (not expressly shown) connected to the drilling rig that provide tension on the marine drilling riser as the drilling rig moves in the water of the offshore environment.

While only two riser sections 408*a* and 408*b* are shown in FIG. 4, any number of riser sections 408 may be placed between the components of gas handler system 400. Additionally, while flow spool 432 and riser sealing tool 434 are shown as directly coupled in FIG. 4, one or more components of the marine drilling riser, such as a riser section 408 may be coupled between flow spool 432 and riser sealing tool 434. Similarly, while riser sealing tool 434 and crossover spool 444*b* are shown as directly coupled in FIG. 4, one or more components of the marine drilling riser, such as a riser section 408 may be coupled between riser sealing tool 434 and crossover spool 444*b*.

Embodiments disclosed herein include:

A. A gas handler system including a flow spool; a riser sealing tool coupled to the flow spool; a rotating control device coupled to the riser sealing tool below a tension ring of a riser section of a drilling riser, the rotating control device fluidically coupled to the flow spool; and an auxiliary line routed around the rotating control device between the riser sealing tool and the riser section.

B. A drilling riser including a tension ring; a first riser section coupled to the tension ring; a rotating control device coupled to the first riser section; a riser sealing tool coupled to the rotating control device; an auxiliary line coupled to an outer perimeter of the first riser section, the auxiliary line routed around the rotating control device between the first riser section and the riser sealing tool; a flow spool coupled to the riser sealing tool, the flow spool fluidically coupled to the rotating control device; and a second riser section coupled to the flow spool.

C. A method of deploying a drilling riser including coupling a first riser section to a downhole end of a tension ring; coupling a rotating control device to the first riser section; coupling a riser sealing tool to the rotating control device; routing an auxiliary line around the rotating control device between the first riser section and the riser sealing tool; coupling a flow spool to the riser sealing tool; and coupling the flow spool to a second riser section.

Each of embodiments A, B, and C may have one or more of the following additional elements in any combination: Element 1: further comprising a first crossover spool coupling the rotating control device to the drilling riser, the first crossover spool including: a riser connector having a first diameter; a rotating control device connector having a second diameter; and a fitting through which the auxiliary line passes. Element 2: further comprising a second crossover spool coupling the rotating control device to the riser sealing tool, the second crossover spool including: a riser connector having a first diameter; a rotating control device connector having a second diameter; and a fitting through which the auxiliary line passes. Element 3: wherein at least one of the riser connector and the rotating control device connector is a compact flange connector. Element 4: wherein the first diameter is different from the second diameter. Element 5: wherein: the first diameter corresponds to a diameter of the riser section; and the second diameter corresponds to a diameter of the rotating control device.

Element 6: wherein the fitting aligns with a line routed along an outer perimeter of the drilling riser. Element 7: wherein the riser sealing tool is an annular blowout preventer. Element 8: wherein the rotating control device is located below a termination joint and the auxiliary line is fluidically coupled to the termination joint. Element 9: further comprising coupling a first crossover spool between the rotating control device and the first riser section, the first crossover spool including: a riser connector having a first diameter; a rotating control device connector having a second diameter; and a fitting through which the auxiliary line passes. Element 10: further comprising coupling a second crossover spool between the rotating control device and the riser sealing tool, the second crossover spool including: a riser connector having a first diameter; a rotating control device connector having a second diameter; and a fitting through which the auxiliary line passes.

Although the present disclosure and its advantages have been described in detail, it should be understood that various changes, substitutions and alterations can be made herein without departing from the spirit and scope of the disclosure as defined by the following claims.

What is claimed is:

1. A gas handler system comprising:
- a flow spool;
- a riser sealing tool coupled to the flow spool;
- a rotating control device coupled to the riser sealing tool below a tension ring of a riser section of a drilling riser, the rotating control device fluidically coupled to the flow spool;
- an auxiliary line routed around the rotating control device between the riser sealing tool and the riser section; and
- a first crossover spool coupling the rotating control device to the drilling riser, the first crossover spool including:
  - a riser connector having a first diameter;
  - a rotating control device connector having a second diameter different from the first diameter; and
  - a fitting through which the auxiliary line passes.

2. The gas handler system of claim 1, further comprising a second crossover spool coupling the rotating control device to the riser sealing tool, the second crossover spool including:
- a riser connector having a first diameter;
- a rotating control device connector having a second diameter; and
- a fitting through which the auxiliary line passes.

3. The gas handler system of claim 1, wherein at least one of the riser connector and the rotating control device connector is a compact flange connector.

4. The gas handler system of claim 1, wherein:
- the first diameter corresponds to a diameter of the riser section; and
- the second diameter corresponds to a diameter of the rotating control device.

5. The gas handler system of claim 1, wherein the fitting aligns with a line routed along an outer perimeter of the drilling riser.

6. The gas handler system of claim 1, wherein the riser sealing tool is an annular blowout preventer.

7. The gas handler system of claim 1, wherein the rotating control device is located below a termination joint and the auxiliary line is fluidically coupled to the termination joint.

8. A drilling riser comprising:
- a tension ring;
- a first riser section coupled to the tension ring;
- a rotating control device coupled to the first riser section;
- a riser sealing tool coupled to the rotating control device;
- an auxiliary line coupled to an outer perimeter of the first riser section, the auxiliary line routed around the rotating control device between the first riser section and the riser sealing tool;
- a flow spool coupled to the riser sealing tool, the flow spool fluidically coupled to the rotating control device;
- a second riser section coupled to the flow spool; and
- a first crossover spool coupling the rotating control device to the drilling riser, the first crossover spool including:
  - a riser connector having a first diameter;
  - a rotating control device connector having a second diameter different from the first diameter; and
  - a fitting through which the auxiliary line passes.

9. The drilling riser of claim 8, further comprising a second crossover spool coupling the rotating control device to the riser sealing tool, the second crossover spool including:
- a riser connector having a first diameter;
- a rotating control device connector having a second diameter; and
- a fitting through which the auxiliary line passes.

10. The drilling riser of claim 8, wherein the first diameter corresponds to a diameter of the riser section and the second diameter corresponds to a diameter of the rotating control device.

11. The drilling riser of claim 8, wherein the riser sealing tool is an annular blowout preventer.

12. The drilling riser of claim 8, wherein the rotating control device is located below a termination joint and the auxiliary line is fluidically coupled to the termination joint.

13. A method of deploying a drilling riser comprising:
- coupling a first riser section to a downhole end of a tension ring;
- coupling a rotating control device to the first riser section;
- coupling a riser sealing tool to the rotating control device;
- routing an auxiliary line around the rotating control device between the first riser section and the riser sealing tool;
- coupling a flow spool to the riser sealing tool;
- coupling the flow spool to a second riser section; and
- coupling a first crossover spool between the rotating control device and the first riser section, the first crossover spool including:
  - a riser connector having a first diameter;
  - a rotating control device connector having a second diameter different from the first diameter; and
  - a fitting through which the auxiliary line passes.

14. The method of claim 13, further comprising coupling a second crossover spool between the rotating control device and the riser sealing tool, the second crossover spool including:
- a riser connector having a first diameter;
- a rotating control device connector having a second diameter; and
- a fitting through which the auxiliary line passes.

15. The method of claim 13, wherein the riser sealing tool is an annular blowout preventer.

16. The method of claim 13, wherein the rotating control device is located below a termination joint and the auxiliary line is fluidically coupled to the termination joint.

* * * * *